US005259744A

United States Patent [19]

Take

[11] Patent Number: 5,259,744

[45] Date of Patent: Nov. 9, 1993

[54] DEVICES FOR FORMING TWO-TIER HELICAL GEARS

[75] Inventor: Ryota Take, Itami, Japan

[73] Assignee: Sumitomo Electric Industries, Ltd., Osaka, Japan

[21] Appl. No.: 765,034

[22] Filed: Sep. 24, 1991

[30] Foreign Application Priority Data

Sep. 25, 1990 [JP] Japan ..... 2-256056

[51] Int. Cl.[5] ..... B22F 5/00

[52] U.S. Cl. ..... 425/78; 425/352; 425/414; 425/415; 425/418

[58] Field of Search ..... 425/78, 352, 354, 355, 425/406, 412, 414, 415, 418, 77, 356

[56] References Cited

U.S. PATENT DOCUMENTS 3,020,589 2/1962 Maritano ..... 425/354
3,694,127 9/1972 Takahashi et al. ..... 425/352
3,909,167 9/1975 Signora ..... 425/418

FOREIGN PATENT DOCUMENTS 56-12398 3/1981 Japan ..... 425/78
1-195202 8/1989 Japan ..... 425/78
1419770 12/1975 United Kingdom ..... 425/78

*Primary Examiner*—Scott Bushey
*Attorney, Agent, or Firm*—Wenderoth, Lind & Ponack

[57] ABSTRACT

A device for forming a two-tiered external helical gear, having upper and lower parts having pitch circles of different diameters, includes a die, an upper punch and a lower punch which are rotatable relative to one another, and a core. The die is formed on the inner periphery with helical teeth in two tiers. The upper and lower teeth have the same twisting direction and lead and have pitch circles of diameters corresponding to the diameters of the pitch circles of the upper and lower parts of the gear. The upper punch is formed on the outer periphery with helical teeth adapted to mesh with the first tier of helical teeth on the inner periphery of the die. The lower punch is formed on the outer periphery thereof with helical teeth adapted to mesh with the second tier of helical teeth on the inner periphery of the die. There is also provided a similar device for forming a two-tiered internal helical gear.

5 Claims, 1 Drawing Sheet

DEVICES FOR FORMING TWO-TIER HELICAL GEARS

BACKGROUND OF THE INVENTION

This invention relates to a device for forming a two-tiered helical gear, comprising upper and lower parts having different diameters, by sintering a powdery material. One type of the device is for forming external gears and another type is for forming internal gears.

Conventional devices for forming two-tiered sintered helical gears are disclosed in Japanese Patent Publication 48-29900 and in U.S. Pat. No. 3,694,127 corresponding in part thereto. The devices comprise a die, a core, an upper punch and a lower punch concentric with the upper punch and having a regular cylindrical shape. The lower punch is divided into inner and outer pieces. One of the disclosed devices, for forming two-tiered external helical gears, is provided with helical teeth on the outer periphery of both the inner piece of the lower punch and the upper punch, on the inner and outer peripheries of the outer piece of the lower punch, and on the inner periphery of the die.

The other disclosed device, for forming two-tiered internal helical gears, is provided with helical teeth on the inner and outer peripheries of the inner piece of the lower punch, on the inner periphery of both the outer piece of the lower punch and the upper punch, and on the outer periphery of the core. In either device, in order to form gears in a stepped manner, the outer piece of the lower punch and the inner piece of the lower punch have different heights of their top ends.

In such a conventional device, because the lower punch is divided into inner and outer pieces its structure tends to be complicated.

Also, if it is desired to form a gear having a small difference in diameter between its upper and lower parts, the outer piece of the lower punch has to be made thin. Such a punch is liable to break. If the required diameter difference is smaller than a certain level, it may become impossible to provide a two piece lower punch.

Further, a wedge and a fork may be sometimes necessary to pull down the outer piece of the lower punch from the point where the pressing has ended and thus to knock the compacted article out of the die. This will further complicate the structure of the device itself.

SUMMARY OF THE INVENTION

It is an object of this invention to provide a device which solves these problems.

In order to solve these problems, one of the forming devices according to this invention, which is used for forming external helical gears, has a die provided on the inner periphery thereof with helical teeth arranged in two tiers. Such helical teeth have the same twisting direction and lead and have pitch circles of diameters corresponding to the diameters of the pitch circles of the helical gear to be formed. Further, it has an upper punch provided on the outer periphery thereof with helical teeth adapted to mesh with the first-level helical teeth provided on the inner periphery of the die and a lower punch provided on the outer periphery thereof with helical teeth adapted to mesh with the second-level helical teeth provided on the inner periphery of the die.

Another forming device according to this invention, which is used for forming internal helical gears, has a core provided on the outer periphery thereof with helical teeth arranged in two tiers. Such helical teeth have the same twisting direction and lead and have diameters corresponding to the diameters of the helical gear to be formed. Further, it has an upper punch provided on the inner periphery thereof with helical teeth adapted to mesh with the first-level helical teeth on the outer periphery of the core and a lower punch provided on the inner periphery thereof with helical teeth adapted to mesh with the second-level helical teeth on the outer periphery of the core.

The die, upper punch and lower punch of the former device or the core, upper punch and lower punch of the latter are arranged to be rotatable relative to each other as with the prior art devices.

Since the helical teeth at the respective levels have the same helix angle and lead, the upper and lower parts of the gear can be pressed simultaneously without exerting undue forces on the helical gears meshing with the upper and lower parts of the gear. Even when the helical teeth for forming upper and lower parts of the gear are provided either on the die or the core, there will be no difficulty in pulling or pushing out the core or the formed article from the die with the lower punch. This eliminates the necessity of dividing the lower punch, which has been a major cause of the abovementioned various problems. Also, no wedge or fork is necessary for knocking out the formed article. Thus, the entire device has a simpler structure.

Since the lower punch is not divided, it is less likely to be broken. Further, a gear having a very small diameter difference between the upper part and lower part can be formed, which has heretofore been impossible.

The device according to this invention can be used only for forming helical gears in which the upper and lower helical teeth have the same twisting direction and lead. But there is a great demand for such gears, including a significant amount of which have rather small diameter differences between upper and lower parts thereof. Thus this invention is of great value in spite of the fact that the kinds of gears which can be formed by the device of this invention are limited.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 3A:
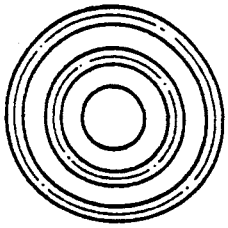
FIG. 3*a* is a plan view of a two tiered external helical gear formed by the device shown in FIG. 1.
Figure 3B:
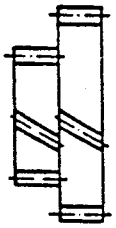
FIG. 3*b* is a side view of the same.
Figure 4A:
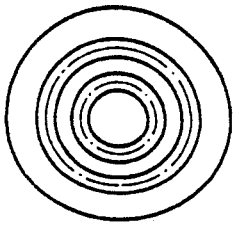
FIG. 4*a* is a plan view of a two-tiered internal helical gear formed by the device shown in FIG. 2.
Figure 4B:
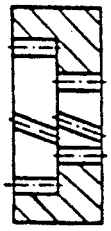
FIG. 4*b* is a side view of the same.
Figure 1:
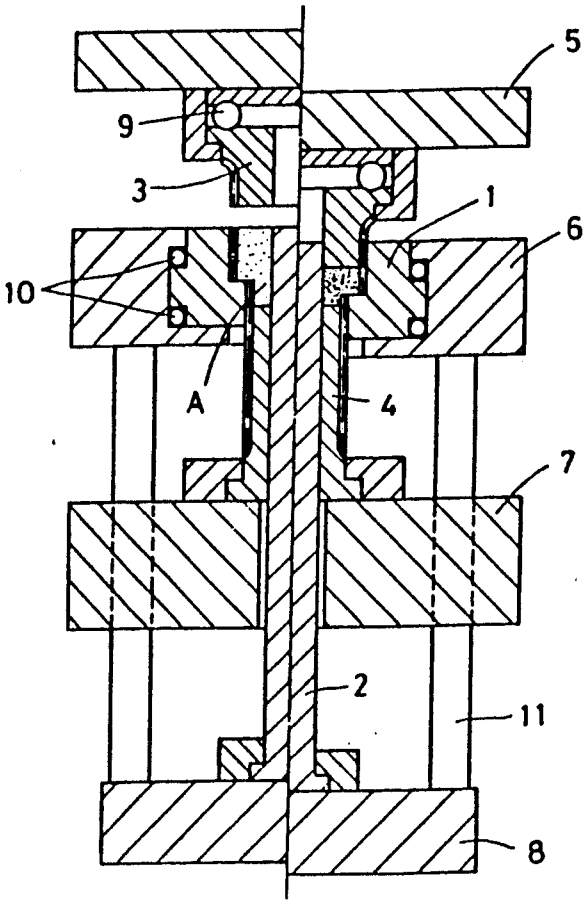
FIG. 1 is a sectional view of the first embodiment according to this invention.
Figure 2:
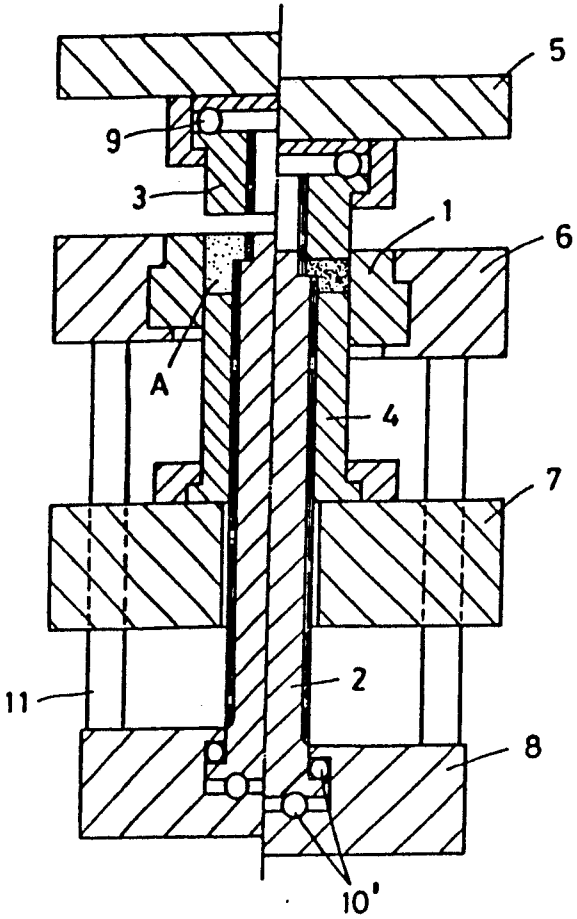
FIG. 2 is a similar sectional view of another embodiment.

The device shown in FIG. 1 is used for forming a two-tiered external helical gear as shown in FIGS. 3*a* and 3*b* whereas the device shown in FIG. 2 is used for forming a two-tiered internal helical gear as shown in FIGS. 4*a* and 4*b*. In in FIGS. 1 and 2, the lefthand side with respect to the centerline shows the state in which a powdery material is merely supplied and the right-hand side shows the state in which the material has been pressed.

The device shown in FIG. 1 is provided with a die 1 rotatably mounted on a die plate 6 through bearings 10. It also has a core rod 2 secured to a yoke plate 8, an upper punch 3 rotatably supported on an upper punch plate 5 through bearings 9, and a lower punch 4 secured to a stationary base plate 7 at a position opposite to and concentric with the upper punch 3.

The upper punch 3 is driven by an upper ram (not shown) of a press coupled to the upper punch plate 5. The yoke plate 8 is coupled to a lower ram (not shown) of the press so as to be driven by it. The die plate 6 is coupled to the yoke plate 8 through coupling rods 11 slidably extending through the base plate 7 and is movable together with the yoke plate 8.

The die 1 of the forming device shown in FIG. 1 is formed on the inner periphery thereof with upper and lower helical teeth having the same twisting direction and lead, the upper and lower teeth having pitch circles of diameters corresponding to the upper and lower diameters of the pitch circles of the teeth of the gear to be formed. The upper punch 3 is formed on the outer periphery thereof with helical teeth adapted to mesh with the upper helical teeth formed on the inner periphery of the die 1 whereas the lower punch 4 is formed on the outer periphery thereof with helical teeth adapted to mesh with the lower helical teeth on the inner periphery of the die 1.

In the operation of the device of FIG. 1, a powdery material A is fed into the cavity defined by the die 1, the lower punch 4 and the core rod 2 and is pressed by lowering the upper punch 3. Since the lower punch 4 is held in a stationary position and the helical teeth on the outer periphery of the lower punch 4 mesh with the lower helical teeth on the inner periphery of the die 1, the die rotates when lowered due to the lead of the helical teeth. The upper punch 3 will also rotate relative to the die 1 since the helical teeth on the outer periphery thereof mesh with the upper helical teeth on the inner periphery of the die 1. Thus, the upper punch 3 moves into the die 1 while rotating in the same direction as the die but at a greater speed than the die.

When the pressing is complete, the yoke plate 8 is lowered to pull out the core rod 2. At the same time, the die 1 is lowered while rotating to push out the formed article.

The device shown in FIG. 2 has a core rod 2 formed on the outer periphery thereof with upper and lower helical teeth having the same twisting direction and lead, the upper helical teeth being in meshing engagement with helical teeth formed on the inner periphery of the upper punch 3 and the lower helical teeth being in meshing engagement with helical teeth formed on the inner periphery of the lower punch 4. The core rod 2 is rotatably supported on the yoke plate 8 through bearings 10' so that it will rotate when pressing and when removing the formed article. Otherwise, this device is the same as the one shown in FIG. 1.

What is claimed is:

1. A device for forming a two-tiered sintered helical gear having upper and lower parts including respective sets of teeth with pitch circles having different diameters from each other, said device comprising: a die having an inner periphery defining a space in the die for accommodating powdery material from which the gear is to be formed, an upper punch and a lower punch which are provided on opposite sides of said space and are supported for rotation relative to one another in the device, and a core extending into said space, said die having first and second tiers of helical teeth on the inner periphery thereof so as to define the outer boundary of said space, said die being a unitary member such that said first and second tiers of helical teeth thereof are integral with one another, said tiers of helical teeth having the same direction of twist and lead and having respective pitch circles of different diameters corresponding to the pitch circles of teeth of the upper and lower parts of the two-tiered helical gear to be formed, said upper punch having helical teeth on the outer periphery thereof capable of meshing with the first tier of helical teeth on the inner periphery of said die, said lower punch having helical teeth on the outer periphery thereof capable of meshing with the second tier of helical teeth on the inner periphery of said die, and said punches being supported in said device for axial movement relative to one another such that powdery material provided in said space is pressable by said punches.

2. A device for forming a two-tiered sintered helical gear as claimed in claim 1, wherein said die is rotatably supported in the device.

3. A device for forming a two-tiered sintered helical gear, said device comprising: a unitary die having an inner periphery defining a space in the die for accommodating powdery material from which the gear is to be formed, an upper punch and a lower punch provided on opposite sides of said space and supported in the device for rotation relative to one another, and a core extending into said space, first and second tiers of helical teeth being provided on one of the inner periphery of said unitary die and the outer periphery of said core so as to bound said space, the helical teeth having the same direction of twist and lead, the respective pitch circles of said first and said second tiers of helical teeth being different, said upper punch having helical teeth capable of meshing with said first tier of helical teeth, said lower punch having helical teeth capable of meshing with said second tier of helical teeth, and said punches also being supported for axial movement relative to one another such that powdery material provided in said space is pressable by said punches.

4. A device for forming a two-tiered sintered helical gear as claimed in claim 3, wherein said tiers of helical teeth are provided on the outer periphery of said core so as to define the inner boundary of said space, the upper and the lower punches each have an inner periphery defining a hole therein, the upper punch has the helical teeth provided on the inner periphery thereof, and the lower punch has the helical teeth provided on the inner periphery thereof.

5. A device for forming a two-tiered sintered helical gear as claimed in claim 4, wherein said core rod is rotatably supported in the device.

* * * * *